United States Patent [19]

Korbach et al.

[11] Patent Number: 4,828,656

[45] Date of Patent: May 9, 1989

[54] HIGH PERFORMANCE ELECTRODEPOSITED CHROMIUM LAYERS

[75] Inventors: William C. Korbach, Howell; Warren H. McMullen, E. Brunswick, both of N.J.

[73] Assignee: M&T Chemicals Inc., Woodbridge, N.J.

[21] Appl. No.: 12,518

[22] Filed: Feb. 9, 1987

[51] Int. Cl.[4] ..... C25D 3/56

[52] U.S. Cl. ..... 204/43.1; 420/428

[58] Field of Search ..... 204/43.1, 51; 420/428; 428/666, 667

[56] References Cited

U.S. PATENT DOCUMENTS

| | | | |
|---|---|---|---|
| 3,745,097 | 7/1973 | Chessin et al. | 204/51 |
| 3,758,390 | 9/1973 | Chessin et al. | 204/51 |
| 4,062,737 | 12/1977 | Barclay et al. | 204/43.1 |
| 4,406,756 | 9/1983 | Baranyi | 204/51 |
| 4,472,249 | 9/1984 | Chessin | 204/51 |
| 4,588,481 | 5/1986 | Chessin et al. | 204/51 |

*Primary Examiner*—G. L. Kaplan

*Attorney, Agent, or Firm*—S. A. Marcus; W. Katz

[57] ABSTRACT

A chromium plating bath which consists essentially of chromic acid and 40–100 g/l of sulfoacetic acid, and which is substantially free of carboxylic acid, fluoride, iodide, bromide and selenium ions, is described herein.

16 Claims, 1 Drawing Sheet

CHROMIUM ARTICLE OF INVENTION

CHROMIUM ARTICLE OF INVENTION

CHROMIUM ARTICLE OF PRIOR ART

HIGH PERFORMANCE ELECTRODEPOSITED CHROMIUM LAYERS

BACKGROUND OF THE INVENTION

1. Field of the Invention

This invention relates to electrodeposited layers, and more particularly, to functional electrodeposited chromium layers having advantageous performance properties, and to a chromium plating bath and method for forming such useful chromium electrodeposits.

2. Description of the Prior Art

Hexavalent chromium plating baths are described in U.S. Pat. Nos. 2,750,337; 3,310,480; 3,311,548; 3,745,097; 3,654,101; 4,234,396; 4,406,756; 4,450,050; 4,472,249; and 4,588,481. These baths generally are intended for "decorative" chromium plating or for "functional" (hard) chromium electrodeposition. Decorative chromium plating baths are concerned with deposition over a wide plating range so that articles of irregular shape be completely covered. Functional chromium plating, on the other hand, is designed for regularly shaped articles, where plating at a higher current efficiency and at higher current densities is important.

Functional hexavalent chromium plating baths containing chromic acid and sulfate as a catalyst generally permit the deposition of chromium on a basis metal substrate at cathode efficiencies of about 12% to 16% at current densities of about 1 to 6 asi. Mixed catalyst chromic acid plating baths containing both sulfate and fluoride ions generally allow chromium plating at higher cathode efficiencies, e.g. of 22% to 26%, and at higher rates. However, the presence of fluoride ion in such baths causes etching of ferrous based metal substrates.

Other chromium plating baths which use iodide, bromide or chloride ions as additives can operate at even high current efficiencies, but such baths produce chromium deposits which do not adhere well to the substrate, and which are dull in appearance, or at best only semi-bright. For example, Chessin, in U.S. Pat. No. 4,472,249, describes a high energy efficient functional chromium electroplating bath which operates at very high current efficiencies, e.g. about 50%. These baths generally consist of chromic acid, sulfate, iodide, and a carboxylate, and baths are used at conventional current densities between about 1 to 6 asi. Unfortunately, this bath has adherence problems, poor low current density etching, and provides only a semi-bright deposit.

Chessin and Newby, in U.S. Pat. No. 4,588,481, describes a method for producing non-iridescent, adherent, bright chromium deposits at high efficiencies without low current density etching. This method involves plating at a temperature of 45°–70° C. from a functional chromium plating bath consisting essentially of chromic acid and sulfate, and a non-substituted alkyl sulfonic acid having a ratio of S/C of $>\frac{1}{3}$, in the absence of a carboxylic or dicarboxylic acid.

Suzuki and Tsukakoshi, in U.S. Pat. Nos. 4,453,172 and 4,592,819, describe a very high speed plating apparatus for electroplating metals, e.g. chromium, within a very short time period. In this method, a flowing plating liquid is circulated at a high speed between a workpiece and anode in the plating chamber. The operating current densities permissible in such a system can range from 50–90 asi, which is an extraordinarily high current density, but which enables plating to occur very rapidly. In fact, the apparatus is referred to in the art as a "Rapid Plating System" (RPS). Unfortunately, the demands of this system necessitate a chromium plating bath which can operate under the extreme RPS conditions, and provide high performance chromium electrodeposits.

Accordingly, it is an object of the present invention to provide a high performance electrodeposited chromium layer, a chromium plating bath, and a method for forming such chromium electrodeposits, particularly under RPS conditions.

A specific object herein is to provide chromium electrodeposits which are adherent, bright, smooth, hard, wear resistant, exhibit a low coefficient of friction, and which can be formed at useful current densities, including both the very high operating densities of rapid plating systems, and the low current densities of conventional chromium plating.

These and other objects will be made apparent from the following more detailed description of the invention.

SUMMARY OF INVENTION

In accordance with the above objects of the invention, there is provided herein high performance chromium electrodeposited layers, a chromium plating bath, and a process by which such high performance, functional chromium electrodeposits can be obtained, both at conventional plating current densities, and under high current density rapid plating conditions.

The chromium electrodeposit of the invention is characterized by having a high concentration of sulfur therein, particularly, at least about 0.4% by weight, and suitably, about 0.4–1% by weight of the chromium layer.

The chromium plating bath of the invention consists essentially of chromic acid, and sulfoacetic acid, in a concentration range of about 40 g/l to 100 g/l.

The plating bath is further characterized by being substantially free of deleterious carboxylic acids and dicarboxylic acids, alkyl sulfonic acids, fluoride ion, bromide ion, selenium ion, and iodide ion.

The plating process of the invention can be carried out at conventional low current densities, e.g. 1–6 asi. However, the plating bath herein also can be operated under rapid plating conditions, i.e. at very high current densities, e.g. 50–90 asi, at which current densities a substantial deposition can occur within seconds rather than the minutes required at conventional plating current densities.

DETAILED DESCRIPTION OF THE INVENTION

A typical functional chromium electroplating bath in accordance with the invention has the following constituents present in g/l.

TABLE I

| | Suitable | Preferred |
|---|---|---|
| Constituent | | |
| Chromic acid | 200–450 | 250–350 |
| Sulfoacetic acid* | 40–100 | 70–90 |
| Optional Constituent | | |
| Sulfate | 0–4.5 | 2.5–3.5 |
| Operating Conditions | | |
| Rapid Plating (per U.S. Pat. No. 4,543,172) | | |
| Current density (asi) | 50–90 | 70–80 |
| Temperature (°C.) | 50–70 | 55–60 |
| Conventional Plating | | |
| Current density (asi) | 1–5 | 2–3 |
| Temperature (°C.) | 45–70 | 50–60 |

*Sulfoacetic acid can be present also as sulfoacetate, or isethionic acid or an isethionate, which oxidize in the plating bath to provide sulfoacetic acid in the desired concentration. The current efficiencies of using the plating bath composition of the invention is shown in Table II below for different plating conditions.

TABLE II

| Plating Condition | Plating Efficiency |
|---|---|
| High Current Densities | 50% |
| Conventional Low Current Densities | 25% |

A typical chromium electrodeposit formed on a basis metal, e.g. steel, from the electroplating bath of the invention under the conditions described above has the following physical properties, chemical composition and performance characteristics.

TABLE III

| | |
|---|---|
| Physical Properties | |
| Adhesion to substrate | excellent |
| Brightness | excellent |
| Structure | cohesive laminar |
| Surface | smooth |
| Thickness | 0.1–2 mils (rapid plating) |
| | >0.1 mils (conventional plating) |
| Chemical Composition | |
| Sulfur content | 0.4–1% by weight |
| Performance Characteristics | |
| Hardness | $KN_{100}$ > 1100, e.g. 1100–1400* |
| Coefficient of friction | excellent |
| Wear resistance | excellent |

*$KN_{100}$ is Knoop Hardness employing a 100 g weight. All values are expressed in Knoop Hardness Units (KN).

Figure 1:
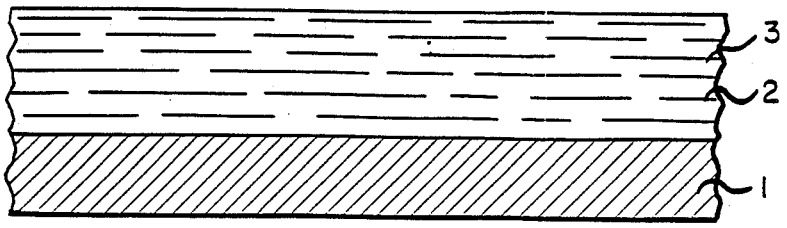
FIG. 1 is a cross-sectional view which shows the cohesive laminar structure of the chromium electrodeposit of the present invention.

Referring now to the drawings, FIG. 1 shows the chromium article of the present invention which is produced at both high and low-current densities. The article includes substrate 1, generally a basis metal, e.g. a steel shock part, on which is electrodeposited a chromium layer 2 in accordance with the invention. The chromium layer 2 has a cohesive laminar structure 3 and a surface which is smooth and substantially planar. The laminar structure provides enhanced wear characteristics, and low coefficient of friction, to the chromium layer. The hardness property is retained even after heat treatment at elevated temperatures. For example, a hardness value $KN_{100}$ of 1397 KH as plated will show a value of 1376 after 2 hrs. at 900° F.

Figure 2:
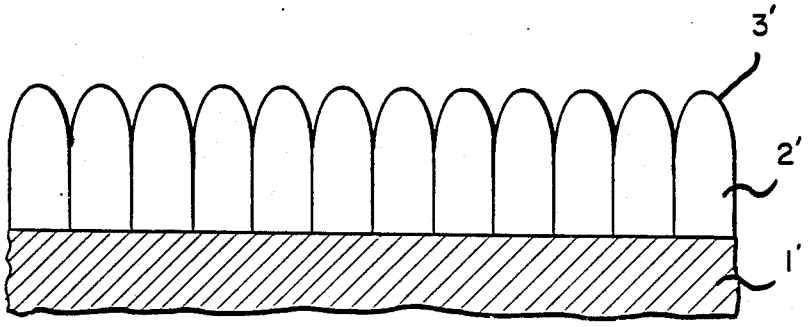
FIG. 2 is a cross-sectional view of a functional chromium article of the prior art which shows the columnar structure of the chromium electrodeposit.

A chromium article produced from conventional chromium plating baths at high current densities is illustrated in FIG. 2. The chromium layer 2' has a columnar structure 3' which will allow for chipping and break off of chromium pieces, particularly during post-finishing steps, and this results in scratching the plated part.

The invention will be described in more detail hereinafter with reference to the following examples.

LOW CURRENT DENSITY PLATING

Example 1

A chromium electroplating bath was prepared having the following composition.

| | |
|---|---|
| Chromic Acid | 250 g/l |
| Sulfoacetic acid | 40 g/l |

Chromium was plated from this bath onto a steel mandrel at 5 asi, at 60° C. for 20 min., to produce a chromium layer thereon having a thickness of 0.8 mils. The current efficiency was 20%. The chromium electrodeposit had the physical and performance properties given in Table II above. The hardness value $KN_{100}$ was 1397. The sulfur content in the layer was 0.41% by weight S.

Example 2

A chromium electroplating bath was prepared having the following composition.

| | |
|---|---|
| Chromic Acid | 250 g/l |
| Sulfoacetic acid | 40 g/l |

Chromium was plated from this bath onto a steel mandrel at 5 asi, at 60° C. for 20 min. to produce a chromium layer thereon having a thickness of 0.8 mils. The current efficiency was 20%.

The chromium electrodeposit had the physical and performance properties given in Table II above. The hardness value $KN_{100}$ was 1385. The sulfur content in the layer was 0.69% by weight S.

Example 3

The chromium plating bath had the following composition:

| | |
|---|---|
| Chromic acid | 250 g/l |
| Sulfate | 2.5 g/l |
| Sulfoacetic acid | 80 g/l |

Chromium was plated onto a steel mandrel at 3 asi at 60° C. for 30 minutes to produce a chromium layer having a thickness of 1.0 mil. The current efficiency was 25%. The physical properties and chemical composition of the chromium electrodeposit were similar to those given in Table II above. The hardness values $KN_{100}$ was 1385. The sulfur content of the layer was 0.57% by weight.

HIGH CURRENT DENSITY PLATING (Rapid Plating Conditions)

Example 4

A chromium electroplating solution having the following composition:

| | |
|---|---|
| Chromic acid | 250 g/l |
| Sulfate | 0.83 g/l |
| Sulfoacetic acid | 80 g/l |

was circulated at a pump speed of 5 cu. meters/hr. between a steel shock workpiece and a platinized titanium anode at 60° C., in the apparatus described in U.S.

Pat. No. 4,543,172. The high speed flow of plating solution made the ion diffusion layer in the area around the workpiece thinner, allowing a large current flow at a voltage of 14–20 volts. The current density of 90 asi. After 20 seconds of plating, a chromium deposit of 0.5 mil. was obtained at a current efficiency of 55%. The chromium deposit had substantially the properties given in Table II above. The hardness value, $KN_{100}$ was 1250. The sulfur content was 0.80% by weight S.

Example 5

A chromium electroplating bath was prepared having the following composition.

| | |
|---|---|
| Chromic Acid | 250 g/l |
| Sulfoacetic acid | 100 g/l |
| Sulfate | 2.5 g/l |

Chromium was plated from this bath as in Example 4 above. The current efficiency, physical and performance properties were similar to those in Table II above. The sulfur content in the layer was 1% by weight.

What is claimed is:

1. A chromium electroplating bath suitable for forming, hard, bright, adherent, smooth and wear resistant chromium electrodeposits on a substrate consisting essentially of chromic acid and 40–100 g/l of sulfoacetic acid, wherein said bath is substantially free of other carboxylic acids, fluoride ions, iodide ion, bromide ion, and selenium ion.

2. A chromium electroplating bath according to claim 1 wherein the chromic acid is present in an amount of about 200 g/l to 450 g/l.

3. A chromium electroplating bath according to claim 2 wherein the chromic acid is present in an amount of 250 g/l to 350 g/l.

4. A chromium electroplating bath according to claim 1 wherein the sulfoacetic acid is present in an amount of about 70–90 g/l.

5. A chromium electroplating bath according to claim 1 wherein said bath also includes sulfate in an amount up to about 4.5 g/l.

6. A chromium electroplating bath according to claim 5 wherein the ratio of chromic acid to sulfate is about 100:1.

7. A process for electroplating a chromium layer into a basis metal, which layer is characterized by having a sulfur content of at least about 0.4% by weight, is adherent to said metal, and is bright, hard, smooth and wear resistant, which comprises electrodepositing from an electroplating bath consisting essentially of chromic acid and 40–100 g/l of sulfoacetic acid, said bath being substantially free of other carboxylic acids, fluoride ion, iodide ion, bromide ion, and selenium ion.

8. A process according to claim 7 wherein said bath also includes sulfate in an amount of up to 4.5 g/l.

9. A process according to claim 8 wherein the ratio of chromic acid to sulfate is about 100:1.

10. A process according to claim 7 wherein the sulfoacetic acid is present in an amount of about 70–90 g/l.

11. A process according to claim 7 wherein the chromic acid is present in an amount of about 200 g/l to 450 g/l.

12. A process according to claim 7 wherein said electrodepositing is carried out at a temperature of about 50°–70° C.

13. A process according to claim 7 wherein electrodeposition is carried out at a current density of about 50–90 asi.

14. A process according to claim 13 wherein the thickness of said electrodeposited chromium layer is about 0.1–2 mils.

15. A process according to claim 7 wherein electrodeposition is carried out at a current density of about 1–6 asi.

16. A process according to claim 15 wherein the thickness of said electrodeposited chromium layer is at least 0.1 mil.

* * * * *